US006724176B1

(12) United States Patent
Wong et al.

(10) Patent No.: US 6,724,176 B1
(45) Date of Patent: Apr. 20, 2004

(54) LOW POWER, LOW NOISE BAND-GAP CIRCUIT USING SECOND ORDER CURVATURE CORRECTION

(75) Inventors: Kern W. Wong, Sunnyvale, CA (US); Jane Xin-Leblanc, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/282,694

(22) Filed: Oct. 29, 2002

(51) Int. Cl.[7] ..... G05F 3/20

(52) U.S. Cl. ..... 323/316; 323/314; 327/539; 327/541

(58) Field of Search ..... 323/304, 311–314, 323/316; 327/539–541

(56) References Cited

U.S. PATENT DOCUMENTS 6,031,365 A * 2/2000 Sharpe-Geisler ..... 323/313
6,407,622 B1 * 6/2002 Opris ..... 327/539
6,531,857 B2 * 3/2003 Ju ..... 323/316

* cited by examiner

*Primary Examiner*—Michael Sherry
*Assistant Examiner*—Gary L. Laxton

(57) ABSTRACT

A band-gap reference circuit comprising a first current source for generating a first reference current and a first circuit branch for receiving part of the first reference current. The first circuit branch comprises a first resistor having a positive temperature coefficient in series with a base-emitter junction of a first PNP diode having a negative temperature coefficient. An emitter current of the first PNP diode develops a first combined voltage across the first resistor and the base-emitter junction. A comparison circuit compares the first combined voltage to a base-emitter voltage of a second PNP diode and adjusts a band-gap reference voltage. A correction current generating circuit injects a correction current into an emitter of the second PNP diode that at least partially offsets a non-linear drop-off in the band-gap reference voltage caused by the second PNP diode as temperature increases.

22 Claims, 5 Drawing Sheets

LOW POWER, LOW NOISE BAND-GAP CIRCUIT USING SECOND ORDER CURVATURE CORRECTION

TECHNICAL FIELD OF THE INVENTION

The present invention is generally directed to band-gap reference circuits, and more specifically, to a low power, low noise, fast startup, 1-volt operation band-gap reference circuit using second order curvature correction.

BACKGROUND OF THE INVENTION

Band-gap circuits are well known devices that are used to provide a reference voltage that is relatively constant across a wide temperature range. Exemplary band-gap circuits are disclosed in U.S. Pat. No. 3,887,863 and U.S. Pat. No. 6,278,320. The disclosures of U.S. Pat. Nos. 3,887,863 and 6,278,320 are hereby incorporated by reference into the present disclosure as if fully set forth herein.

The theory of operation of band-gap reference circuits is well known in the art. Two different sized base-emitter diodes are biased with the same current level. Since the diodes are the same size, the diodes operate in different current density. The differences in current density are used to generate a proportional-to-absolute-temperature (PTAT) current. The PTAT current develops a voltage across a resistor, thereby creating a PTAT voltage. The PTAT voltage is proportional to absolute temperature and has a positive temperature coefficient. This voltage is then summed to a base-emitter junction voltage of a diode that has a negative temperature coefficient. The negative temperature coefficient and the positive temperature coefficient cancel each other out, so that the combined voltage across the resistor and the base-emitter junction is constant over temperature.

FIG. 1 illustrates conventional band-gap reference circuit 100 according to an exemplary embodiment of the prior art. Band-gap reference circuit 100 comprises capacitor 195, current sources 110 and 115, amplifiers 120 and 125, N-channel transistors 131–133, resistors 140 and 145, PNP bipolar junction transistors 151–153, amplifier 160, P-channel transistor 165, and resistor 170. PNP bipolar junction transistors 151–153 are connected as diodes and are referred to hereafter as PNP diodes 151–153. According to an exemplary embodiment, PNP diode 151 has an area that is eight times larger than the area of PNP diode 152 (i.e., 8:1 ratio).

Current sources 110 and 115 are current mirrors that generate identical currents I1 and I2, respectively. Amplifier 120 samples the voltage on the drain of N-channel transistor 131, a high impedance node. Amplifier 125 converts the output of amplifier 120 to a control voltage that is applied to the gates of N-channel transistors 131–133. The control voltage forces transistors 131 and 132,to deliver equal currents I1 and I2 to PNP diodes 151 and 152, respectively. Capacitor 105 sets the dominant pole of the feedback loop formed by amplifiers 120 and 125 and N-channel transistor 131.

A temperature independent band-gap reference voltage, V(bg), is established by summing the voltage across a resistor (having a positive temperature coefficient) and the base-emitter voltage, V(be), of a pn junction of a pnp diode having negative temperature coefficient. Typically, the sizes of the pnp diodes are chosen with an 8:1 area ratios (the result of using common centroid matching geometry throughout the industry), as in the case of PNP diodes 151 and 152, so that the PNP diodes operate at unequal current densities.

Let:

1) PNP diode 151 be denoted as D1;

2) PNP diode 152 be denoted as D2; and

3) PNP diode 153 be denoted as D3.

From FIG. 1 it can be seen that:

$$V(be)_{D2}=V(be)_{D1}+I1(Ri), \quad \text{[Eqn. 1]}$$

where Ri is the resistance value of resistor 140.

The current, i, in a PNP diode is given by the equation:

$$i=I_S(e^{V(be)/V_T}), \quad \text{[Eqn. 2]}$$

where i is proportional to area. Rearranging terms in Equation 2 gives:

$$V(be)=V_T[\ln(i/I_S)]. \quad \text{[Eqn. 3]}$$

Substituting V(be) in Equation 3 into Equation 1 gives the expression:

$$V(be)_{D2}-V(be)_{D1}=I1(Ri)=V_T[\ln(8i_{D1}/i_{D1}]. \quad \text{[Eqn. 4]}$$

where $i_{D1}$ is the current in D1 (i.e., PNP diode 151) and $i_{D2}$ is the current in D2 (i.e., PNP diode 152). Since $i_{D1}$ and $i_{D2}$ are equal, Equation 4 reduces to:

$$I1(Ri)=V_T(\ln 8) \quad \text{[Eqn. 5]}$$

Thus, the current I1 in PNP diode 151 is:

$$I1=V_T(\ln 8)/Ri. \quad \text{[Eqn. 6]}$$

It is noted that $V_T$, the thermal voltage has a positive temperature coefficient, $V_T$=+26 mV, at room temperature. Thus, the current I1 is proportional to absolute temperature (PTAT).

The current I1 is mirrored by the current I3 in N-channel transistor 133. The current I3 may be used to establish a band-gap reference voltage, V(bg) for use in biasing, where:

$$V(bg)=I3(k*Rr)+V(be)_{D3}. \quad \text{[Eqn. 7]}$$

By selecting a suitable multiplier, k, such that dV(bg)/dT=0, V(bg) becomes independent of temperature.

Furthermore, it is possible to generate a reference current, I4, that is proportional to V(bg). This is achieved by the feedback loop formed by amplifier 160, P-channel transistor 165 and resistor 170, which generate I4=V(bg)/Ro, where Ro is the resistance value of resistor 170.

As FIG. 1 shows, the band-gap circuit provides a temperature compensated reference voltage output for use by other circuits in a system. A temperature insensitive, high-tolerance band-gap reference circuit is an indispensable building block in modern chip level integrated circuits (ICs). Band-gap reference circuits are used for biasing analog circuits, as a reference level for data converters, to set trip points for comparators and sensors, and the like.

Some applications, such as data converters and low drop-out (LDO) voltage regulators, require low-noise characteristics and a high PSRR (power supply rejection ratio). Prior art devices may employ large value filter capacitor to improve noise and PSRR performance. However, this impacts system cost and board size and, worst of all, slows down turn-on time (i.e., the time it takes for the band-gap reference circuit to stabilize the output voltage after being turned on). For example, many cellular telephones conserve battery power by periodically turning off various circuit-blocks. If the turn-on time is too long, it is not practical to shut off these circuits. This wastes power and impacts system performance. Since band-gap reference circuits are relatively slow to startup, it is necessary that a faster startup technique be incorporated to meet the current needs of cellular telephone and other similar power critical applications.

As mentioned, conventional band-gap reference circuit 100 consumes a relatively large amount of current (>100 microamperes) and is slow to start up (>100 microseconds). Additionally, many modern portable applications, such as cellular telephones and pagers, operate from a +1.2 power supply rail. The V(be) base-emitter voltage drops in band-gap reference circuit 100 leave very little voltage margin with which to operate.

Furthermore, the current (i) in a PNP diode, as defined in Equation 2, exhibits non-linear behavior at high temperature. This is a key element that leads to large variation of band-gap voltage over temperature. Reducing such a variation often requires the introduction of a suitable correction current. Prior art current correction devices require elaborate circuitry and trimming techniques to generate an appropriate non-linear correction current that mitigates the nonlinear behavior of the PNP diode current at high temperature. The result is a flatter band-gap voltage profile over temperature.

Therefore, there is a need in the art for an improved band-gap reference circuit that is capable of operating from a low voltage (e.g., +1.2 volts) power supply rail. More particularly, there is a band-gap reference circuit that uses a simple circuit to generate an appropriate non-linear correction current to correct the nonlinear behavior of the PNP diode current at high temperature.

SUMMARY OF THE INVENTION

To address the above-discussed deficiencies of the prior art, it is a primary object of the present invention to provide an improved band-gap reference circuit. According to an advantageous embodiment of the present invention, the band-gap reference circuit comprises: 1) a first current source for generating a first reference current; 2) a first circuit branch for receiving a portion of the first reference current, the first circuit branch comprising a first resistor having a positive temperature coefficient connected in series with a base-emitter junction of a first PNP diode having a negative temperature coefficient, wherein an emitter current of the first PNP diode develops a first combined voltage across the series connection of the first resistor and the base-emitter junction of the first PNP diode; 3) a comparison circuit for comparing the first combined voltage to a base-emitter voltage of a second PNP diode and, in response to the comparison, adjusting a band-gap reference voltage; and 4) a correction current generating circuit capable of injecting a correction current into an emitter of the second PNP diode, wherein the injected correction current at least partially offsets a non-linear drop-off in the band-gap reference voltage caused by the second PNP diode as temperature increases.

According to one embodiment of the present invention, the band-gap reference circuit further comprises a second current source for generating a second reference current equal to the first reference current, wherein the emitter of the second PNP diode receives at least a portion of the second reference current.

According to another embodiment of the present invention, the correction current generating circuit comprises a first biased-off P-channel transistor, wherein a first leakage current of the first biased-off P-channel transistor comprises at least a portion of the correction current.

According to still another embodiment of the present invention, the first leakage current increases non-linearly as temperature increases.

According to yet another embodiment of the present invention, the correction current generating circuit comprises a second biased-off P-channel transistor, wherein a second leakage current of the second biased-off P-channel transistor comprises at least a portion of the correction current.

According to a further embodiment of the present invention, the second leakage current increases non-linearly as temperature increases.

According to a still further embodiment of the present invention, the band-gap reference circuit further comprises a correction current control circuit for combining the first and second leakage currents to form the correction current.

According to a yet further embodiment of the present invention, the correction current control circuit combines the first and second leakage currents according to a process corner of the band-gap reference circuit.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

FIGS. 2 through 6, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged electronic device that requires a band-gap reference voltage.

Figure 1:
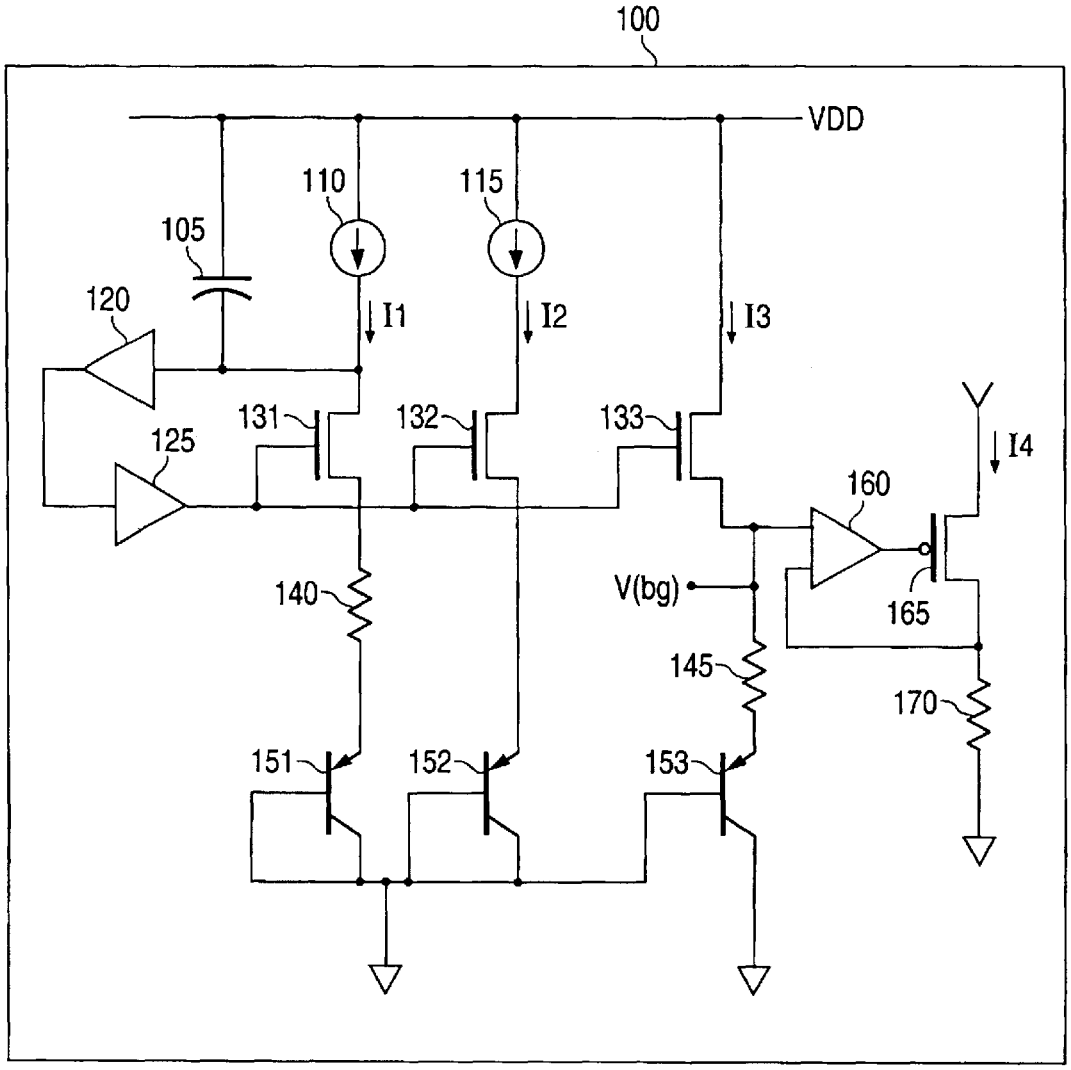
FIG. 1 (PRIOR ART)
FIG. 1 illustrates a conventional band-gap reference circuit according to an exemplary embodiment of the prior art.
Figure 2:
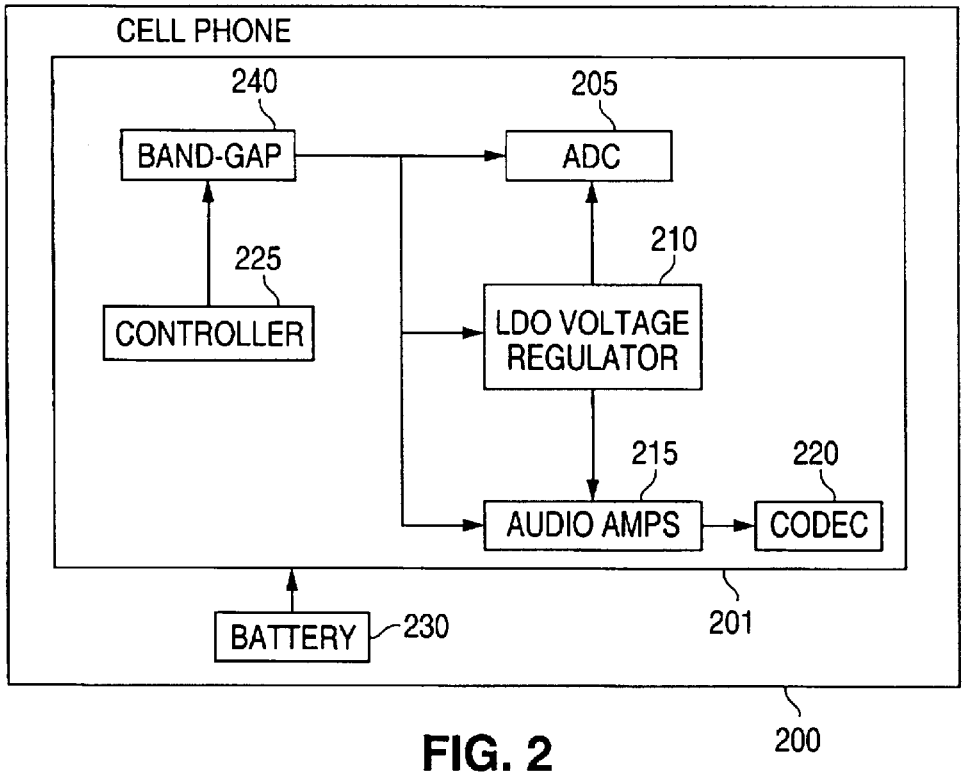
FIG. 2 illustrates a cellular telephone containing a band-gap reference circuit according to the principles of the present invention.

FIG. 2 illustrates cellular telephone 200, which contains band-gap reference circuit 240 according to the principles of the present invention. Cellular telephone 200 contains printed circuit board (PCB) 201, which comprises analog-to-digital converter (ADC) 205, low-drop-out (LDO) voltage regulator 210, audio amplifiers 215, codec 220, controller 225, battery 230, and band-gap reference circuit 240. The V(bg) reference output from band-gap reference circuit 240 provides the voltage reference for ADC 205, LDO voltage regulator 210, audio amplifiers 215 and codec 220, among other circuits.

According to an exemplary embodiment of the present invention, controller 230 of cellular telephone 200 is capable of conserving power and prolonging the operating life of battery 220 by periodically shutting down band-gap reference circuit 240, and many of the other electrical circuits in cellular telephone 200. If the turn-on time of band-gap reference circuit 240 is made extremely short (e.g. 2 microseconds) compared to the 100+microseconds of conventional designs, cellular telephone 200 can be powered back up without any significant delay, thereby saving considerable power over time.

Figure 3:
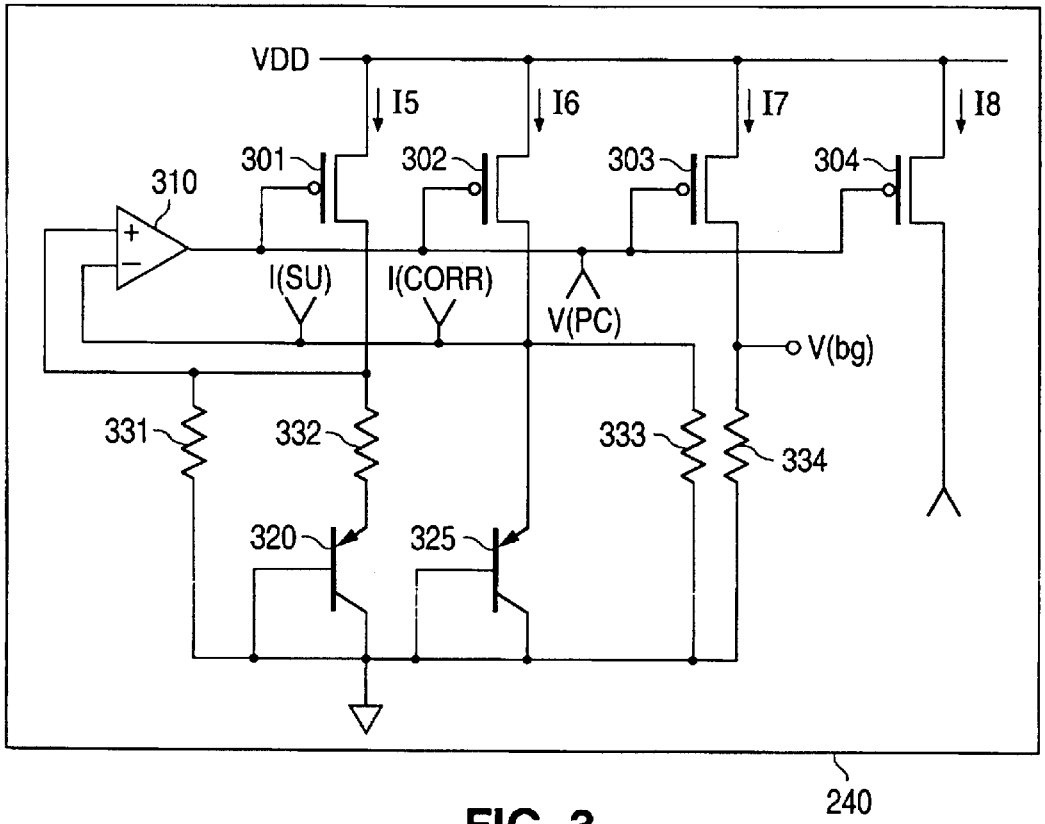
FIG. 3 illustrates a band-gap reference circuit according to an exemplary embodiment of the present invention.

According to an exemplary embodiment of the present invention, the fast startup of band-gap reference circuit 240 is accomplished by injecting a suitable pre-charge current within 0.5 microseconds after power-up into the output of amplifier 310, which drives the common gate nodes of PMOS transistors 301–304 shown in FIG. 3. This pre-charge current is injected using a simple pre-charge circuit, such as the circuit shown in FIG. 6. The pre-charge circuit opens a switch that injects a large amount of current during a short window of time generated by a one-shot circuit formed by an ex-OR gate, a capacitor, and inverters.

FIG. 3 illustrates band-gap reference circuit 240 in greater detail according to an exemplary embodiment of the present invention. Band-gap reference circuit 240 comprises P-channel transistors 301–304, amplifier 310, PNP bipolar junction transistors 320 and 325, and resistors 331–334. PNP bipolar junction transistors 320 and 325 are connected as diodes and are referred to hereafter as PNP diodes 320 and 325. According to an exemplary embodiment, PNP diode 320 has an area that is eight times larger than the area of PNP diode 325 (i.e., 8:1 ratio). As will be explained in FIG. 4 in greater detail, the accuracy of the V(bg) reference voltage may be significantly enhanced by a second order curvature correction circuit 400 (shown in FIG. 4) that injects a correction current, I(CORR), into the node at the emitter of PNP diode 325. Also, as will be explained in FIG. 6 in greater detail, the startup speed of band-gap reference circuit 240 may be greatly decreased by fast start-up circuit 600 (shown in FIG. 6), which initially injects a pre-charge current at the output of amplifier 310 forcing this node to attain its equilibrium voltage value almost instantly. Nominally, within a short period of time (e.g., less than 2 microseconds), the gate voltage of P-channel transistors 301–304 is rapidly pulled to its final operating state.

A conventional band-gap circuit typically employs a startup circuit to ensure the band-gap circuit is correctly powered up. This is due to the fact that a band-gap circuit has two stable states. That is, the band-gap circuit may startup with V(bg)=0 volts and may remain in that state. Alternatively, the band-gap circuit may start up to the desired band-gap voltage level. Thus, an auxiliary circuit is almost always incorporated to ensure that a band-gap circuit starts up to the desired voltage. In the exemplary embodiment, the startup circuit senses the V(bg) node of the band-gap reference circuit for a low voltage (i.e., 0 volts) and forces a small amount of current to the v-(i.e., inverting) input of amplifier 310, which develops a positive voltage and thus starts up band-gap reference circuit 240. Once V(bg) becomes non-zero, the start up circuit is shut off.

Both the startup circuit and the pre-charge (fast start) circuit work together initially during the power-on sequence to ensure the band-gap circuit powers up correctly and, more importantly, powers up quickly to improve system performance. The latter is a feature that has not been incorporated in conventional designs. The fast start-up circuit 600 generates a pre-charge current which causes the bias voltage, V(PC), node to initially go very low to rapidly turn on P-channel transistors 301–304.

The gates of P-channel transistors 301–304 are connected together at the output of amplifier 310. The sources of P-channel transistors are all connected to the VDD supply rail. Thus, P-channel transistors 301–304 all have the same gate-to-source voltage (Vgs) and have the same drain-to-source currents. This means that P-channel transistors 301–304 are current mirrors and currents I5, I6, I7, and I8 are identical.

The non-inverting input of amplifier 310 samples the voltage on the drain of P-channel transistor 301 and the inverting input of amplifier 310 samples the drain voltage of P-channel transistor 302. Current I5 is forced into the circuit branch formed by resistors 331 and 332 and PNP diode 320. Current I6, which is equal to current I5, is forced into the circuit branch formed by resistor 333 and PNP diode 325. Thus, the sum of the currents in resistors 331 and 332 equal the sum of the currents in resistor 333 and PNP diode 325.

Let PNP diode 320 be denoted as "D3" and let PNP diode 325 be denoted as "D4". Also, let R331, R332, R333 and R334 denote the resistance values of resistors 331–334, respectively.

From FIG. 3 it can be seen that, since the non-inverting input voltage v+ and the inverting input voltage v− of amplifier 310 are equal, then:

$$V(be)_{D4}=V+=V-. \quad \text{[Eqn. 8]}$$

since resistor 331 is coupled between v+ and ground, resistor 333 is coupled between v− and ground, and v+ and v− are equal, the same voltage drop exists across resistors 331 and 333. If resistors 331 and 333 are chosen so that R333=R331, then the current I(R331) through resistor 331 is equal to the current I(R333) through resistor 333. Since I5=I6 and I(R331)=I(R333), then [I5-I(R331)]=[I6-I(R333)].

Since $i_{D4}$=[I5-I(R331)] and $i_{D3}$=[I6-I(R333)], then:

$$i_{D4}=i_{D3} \quad \text{[Eqn. 9]}$$

and $$V(be)_{D4}=V(be)_{D3}+i_{D3}(R332). \quad \text{[Eqn. 10]}$$

Regrouping terms gives:

$$i_{D3}=[V(be)_{D4}-V(be)_{D3}]/(R332). \quad \text{[Eqn. 11]}$$

The current, i, in a PNP diode is given by the equation:

$$i=I_S(e^{V(be)/VT}), \quad \text{[Eqn. 12]}$$

where i is proportional to area. Rearranging terms in Equations 11 and 12 gives:

$$i_{D3}=i_{D4}=[V_T(\ln 8)/(R332) \quad \text{[Eqn. 13]}$$

where $i_{D3}$ is the current in D3 (i.e., PNP diode 320) and $i_{D4}$ is the current in D4 (i.e., PNP diode 325).

It is again noted that:

$$I5=i_{D3}+I(R331).$$

Furthermore:

$$i_{D3}=[V_T(\ln 8)/(R332)$$

has a positive temperature coefficient and $$I(R331)=V(be)_{D4}/(R331)$$

has a negative temperature coefficient (i.e., V(be) is −2 mv/degree Celsius).

Since I7 is equal to I5, and I5=$i_{D3}$+I(R331), substituting terms gives:

$$V(bg)=I7(R334)=[[V_T(\ln 8)/(R332)]+V(be)_{D4}/(R331)](R334) \quad \text{[Eqn. 14]}$$

Therefore, it can be seen (to a first order of effects) that the band-gap circuit depends only on the ratio of the resistors value and PNP diode sizes, and is proportional to $V_T$ and V(be).

A band-gap current reference, I8, equal to I5, I6, and I7 is provided by P-channel transistor 304. This is the key application requirement related to the present invention.

Band-gap reference circuit 240 has numerous advantages over conventional band-gap reference circuit 100:

1) band-gap reference circuit 240 is capable of operating at VDD=1 Volt (or lower).

2) The band-gap reference voltage, V(bg), may be less than +1.2 volts and any desirable V(bg) reference value may be tapped off resistor 334.

3) The band-gap reference current, I8, is simply mirrored out by P-channel transistor 304 and no additional amplifiers or other circuitry are needed.

4) A lower operating current (<10 microamperes) is possible with larger current setting resistors (mega-ohm range). Thus, branch currents are 1 microampere or less.

5) The noise current is made smaller with larger resistors, since the square of the noise current is equal to 4 kT/R (i.e., noise current is inversely proportional to R).

However, band-gap reference circuit 240 may be further improved by taking advantage of the process device leakage current characteristics. This may be done by implementing a second order curvature correction circuit that can significantly enhance the accuracy of the V(bg) reference voltage.

Figure 4:
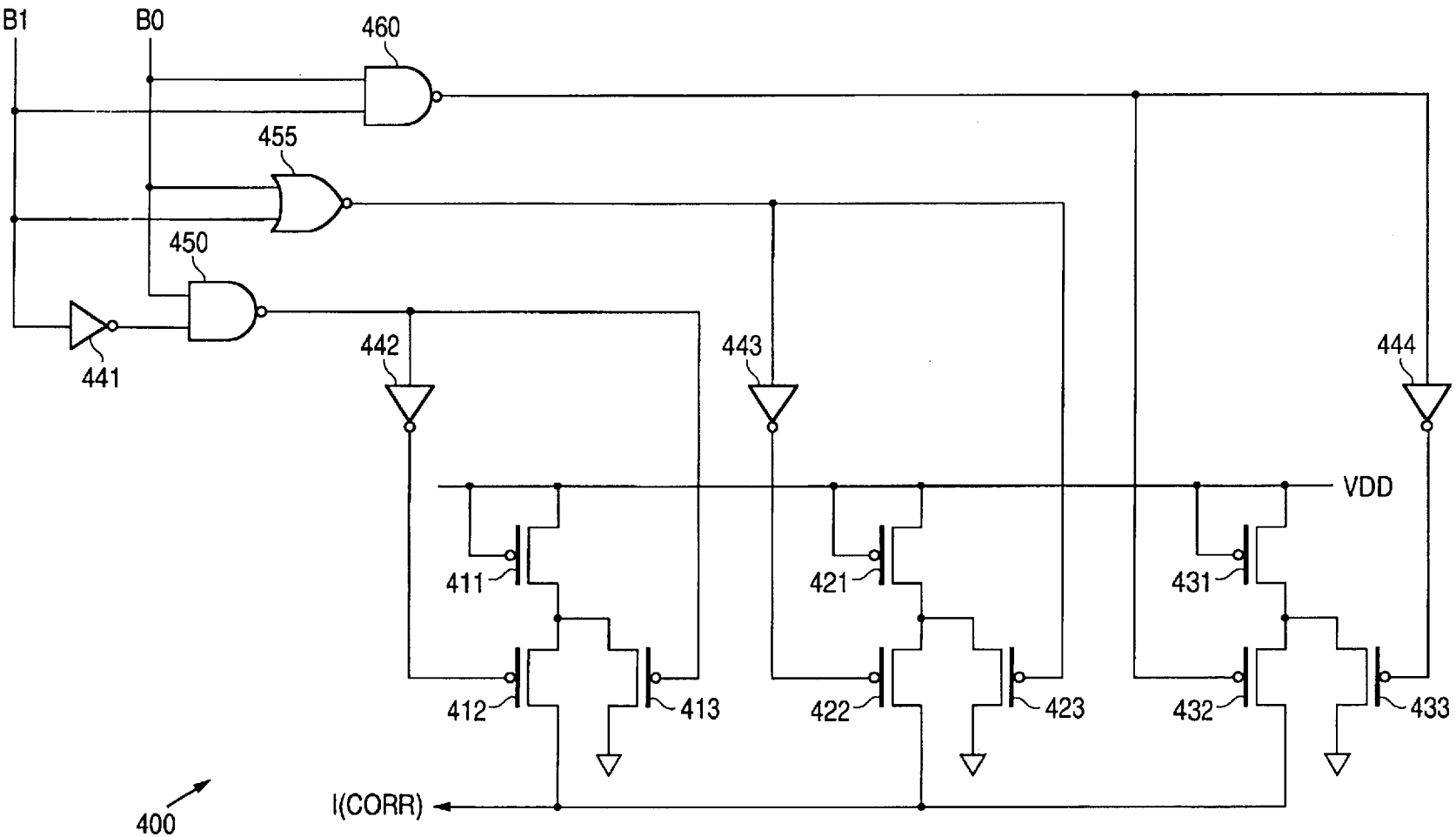
FIG. 4 illustrates a second order curvature correction circuit for use in the band-gap reference circuit according to an exemplary embodiment of the present invention.

FIG. 4 illustrates second order curvature correction circuit 400 for use with band-gap reference circuit 240 according to an exemplary embodiment of the present invention. The accuracy of the V(bg), reference voltage in FIG. 3 may be significantly enhanced by second order curvature correction circuit 400, which injects a correction current, I(CORR), into the node at the emitter of PNP diode 325 in FIG. 3. Second order curvature correction circuit 400 comprises P-channel transistors 411–413, P-channel transistors 421–423 and P-channel transistors 431–433. Second order curvature correction circuit 400 further comprises inverters 441–444, NAND gate 450, NOR gate 444, and NAND gate 460.

The correction current, I(CORR), is determined by the leakage current characteristics of P-channel transistors 411, 421 and 431. It is noted that the gates and sources of P-channel transistors 411, 421 and 431 are connected to the VDD power supply rail. Hence, P-channel transistors 411, 421 and 431 are biased OFF and only the leakage currents of these devices contribute to I(CORR). Properly sizing each one of P-channel transistors 411, 421 and 431 enables second order curvature correction circuit 400 to generate the proper non-linear connection current, I(CORR) for different process corners. In principle, one and only one of P-channel transistors 412, 422 and 423 are enabled at the same time, so that only one of P-channel transistors 411, 421 and 431 generates I(CORR). In practice, however, the correction current, I(CORR), may be generated by selectively combining currents from two or more of transistors 411, 421, and 431 (for different process corners) as depicted in Table 1, thereby saving silicon area. This is a more practical and efficient implementation.

Inverter 442 ensures that when P-channel transistor 412 is ON, P-channel transistor 413 is OFF, and also ensures that when P-channel transistor 412 is OFF, P-channel transistor 413 is ON and shunts the leakage current of P-channel transistor 411 to ground. Inverter 443 ensures that when P-channel transistor 422 is ON, P-channel transistor 423 is OFF and also ensures that when P-channel transistor 422 is OFF, P-channel transistor 423 is ON and shunts the leakage current of P-channel transistor 421 to ground. Finally, inverter 444 ensures that when P-channel transistor 432 is ON, P-channel transistor 433 is OFF and also ensures that when P-channel transistor 432 is OFF, P-channel transistor 433 is ON and shunts the leakage current of P-channel transistor 431 to ground.

P-channel transistors 412, 422 and 432 are used to select P-channel transistors 411, 421 and 431 according to the desired process corner (i.e., fast, typical, or slow). The correction current control bits B1 and B0 determine which ones of P-channel transistors 412, 422 and 432 are ON according to Table 1 below:

TABLE 1

| B1 | B0 | T432 | T412 | T422 | Corner |
|---|---|---|---|---|---|
| 0 | 0 | OFF | ON | ON | slow |
| 0 | 1 | OFF | OFF | OFF | bypass |
| 1 | 0 | OFF | ON | OFF | fast |
| 1 | 1 | ON | ON | OFF | typical |

The correction current, I(CORR), injected at the node at the drain of P-channel transistor flows through resistor 333 and changes the voltage on the inverting node of amplifier 310. As I(CORR) increases, the voltage across resistor 333 increases and the output of amplifier 310 drives the gates of P-channel transistors 301–304 lower, thereby increasing currents I5, I6, I7 and I8. The increase in current I7 increases the voltage at V(bg) in FIG. 3. Conversely, if I(CORR) decreases, the output of amplifier 310 increases, currents I5, I6, I7 and I8 decrease, and the voltage V(bg) decreases.

FIGS. 5A through 5D illustrate the effect of second order curvature correct circuit 400 in FIG. 4 on the band-gap reference voltage, V(bg).

Figure 5A:
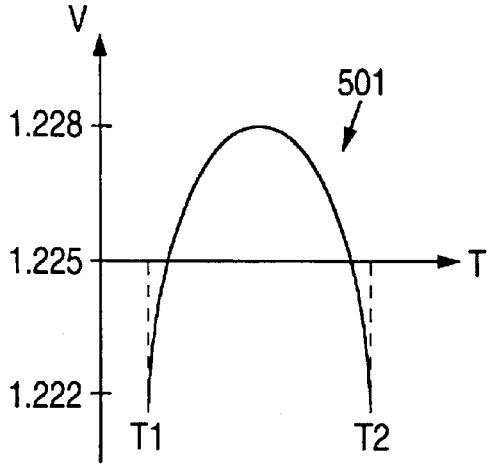
FIGS. 5A through 5D illustrate the effect of the second order curvature correct circuit.

FIG. 5A illustrates curve 501, which depicts V(bg) across the temperature range from T1=−40° C. to T2=+120° C. before curvature correction is applied. Without curvature correction, the first order band-gap reference circuit (shown in FIG. 3) has a V(bg) vs. temperature profile having a parabola-like shape, with a peak-to-peak amplitude variation of about +/−3 mV relative to a nominal value of V(bg)=+1.200 volts.

Figure 5B:
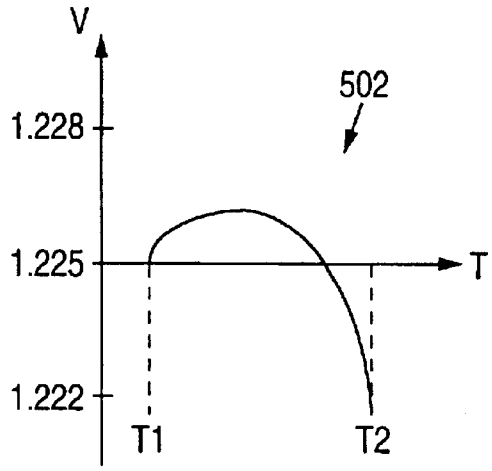

However, the V(bg) vs. temperature profile in FIG. 5A may be intentionally skewed by trimming resistor R332 in FIG. 3. FIG. 5B illustrates curve 502, which depicts a skewed V(bg) profile across the temperature range from T1=−40° C. to T2=+120° C. before curvature correction is applied. The V(bg) vs. temperature profile is not symmetrical, as in FIG. 5A, but rather rolls off more rapidly as temperature increases. However, the positive peak value is not at as great (i.e., about +1.226) as in FIG. 5A.

Figure 5C:
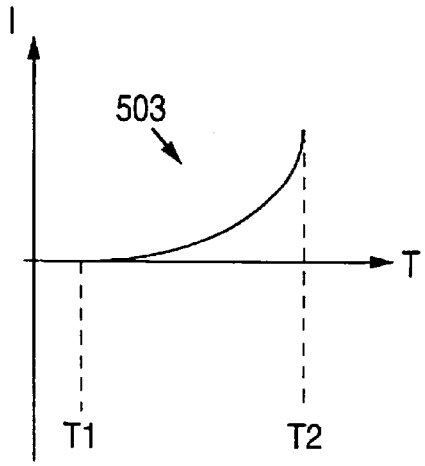

FIG. 5C illustrates curve 503, which depicts the leakage current profile of P-channel transistors 411, 421 and 431 across a range of temperature from T1=−40° C. to T2=+120° C. Leakage current has a non-linear characteristic over temperature. As FIG. 5C illustrates, the leakage current has an exponential rise over temperature. However, the leakage current is well modeled and is based on the reverse current (JS), junction areas, etc. The present invention takes advantage of this normally undesirable effect and turns it into a useful, simple curvature correction current generator to enhance the accuracy of the band-gap reference circuit. Specifically, the rising exponential of the leakage current is used to offset the steep roll-off of the V(bg) reference voltage shown in FIG. 5B.

Figure 5D:
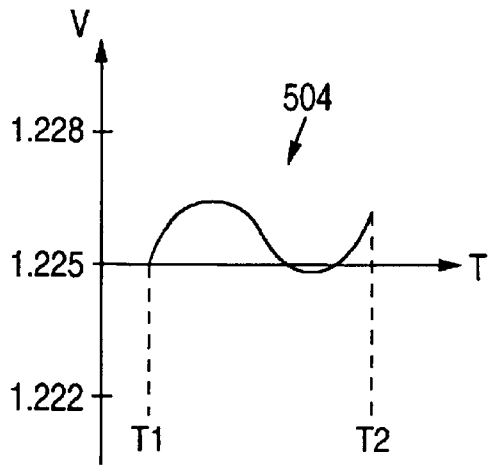

FIG. 5D illustrates curve 504, which depicts V(bg) across the temperature range from Ti=−40° C. to T2=+120° C. after curvature correction is applied. As FIG. 5D illustrates, as temperature increases, the leakage current from one or more of P-channel transistors 411, 421 and 431 increases and is injected as I(CORR) in FIG. 3. The increasing leakage current offsets the increasing steepness of the roll-off of V(bg) in FIG. 5B. Thus, curve 504 has less variation across the temperature range from T1=−40° C. to T2=+120° C.

Figure 6:
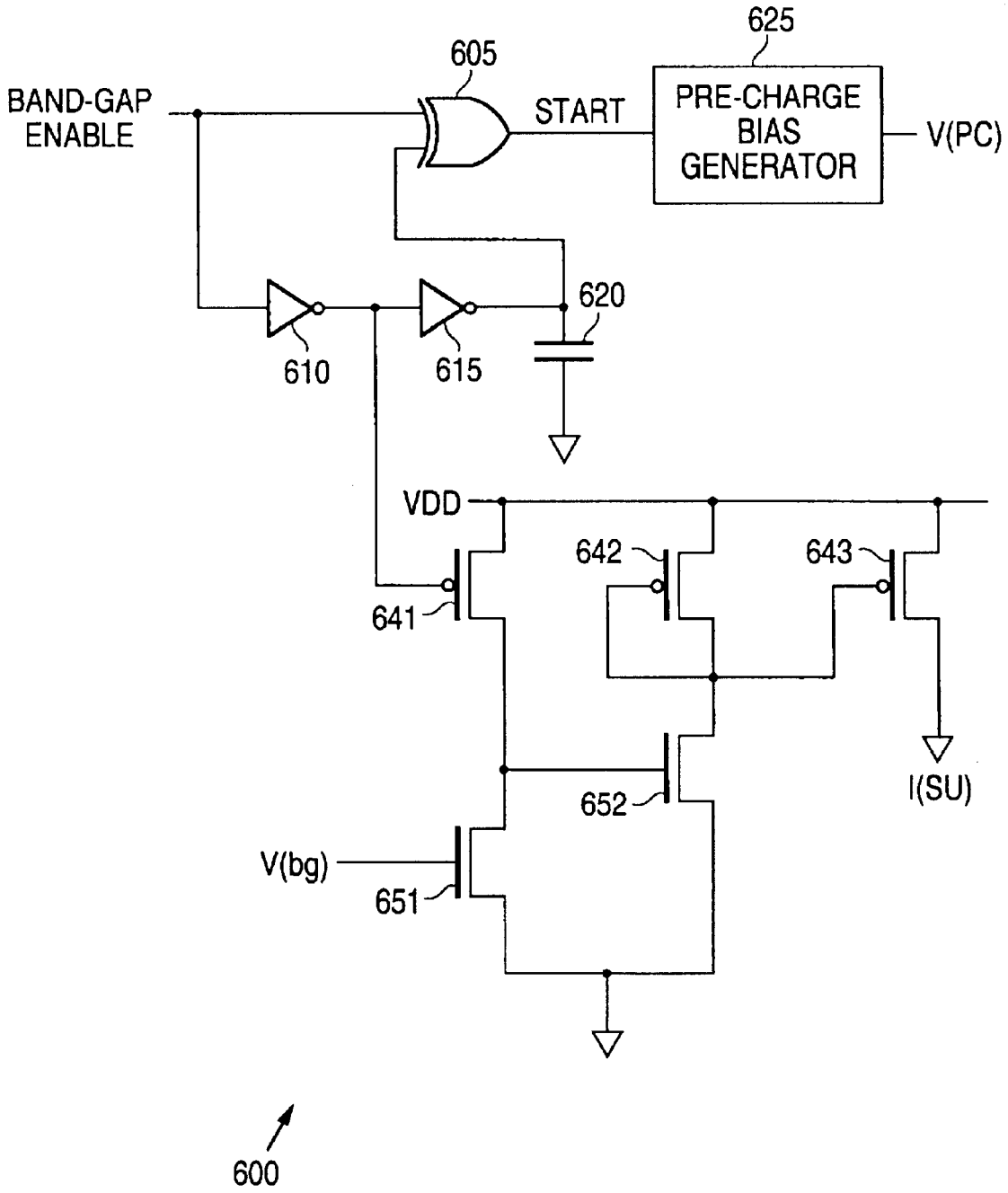
FIG. 6 illustrates a fast start-up circuit for use in the band-gap reference circuit according to an exemplary embodiment of the present invention.

FIG. 6 illustrates fast start-up circuit 600 for use with band-gap reference circuit 240 according to an exemplary embodiment of the present invention. Fast start-up circuit 600 comprises exclusive-OR (XOR) gate 605, inverters 610 and 615, capacitor 620, pre-charge bias generator 625, P-channel transistors 641, 642 and 643, and N-channel transistors 651 and 652.

Initially, the V(bg) signal from FIG. 3 is zero volts and the Band-Gap Enable signal is also zero volts. Since Band-gap Enable is low, the output of inverter 601 is high and the output of inverter 615 is low. Thus, the charge on capacitor 620 is zero volts and the two inputs of XOR gate 605 are both low. This means that the Start signal at the output of XOR gate 605 is low (i.e., OFF), pre-charge bias generator 625 is off, and the pre-charge voltage, V(PC), is off (i.e., high impedance state).

The high at the output of inverter 610 biases P-channel transistor 641 off. Since V(bg) is low, N-channel transistor 651 also is off. Since P-channel transistor 641 and N-channel transistor 651 are both off, N-channel transistor 652 also is off. Since N-channel transistor 652 is off, P-channel transistors 642 and 643 are both off.

When the Band-Gap Enable signal finally goes high, the output of inverter 610 instantly goes low, but the output of inverter 615 is prevented from instantly going high by capacitor 620. Thus, the inputs of XOR gate 605 are temporarily different so that the output of XOR gate 605 (i.e. the Start signal) temporarily goes high. This enables pre-charge bias generator 625 to briefly generate a low voltage (i.e., zero) at V(PC) that is used to rapidly turn on P-channel transistors 301–304.

Also, when the Band-Gap Enable signal goes high and causes the output of inverter 610 to instantly go low, P-channel transistor 641 turns on, thereby increasing the gate voltage on N-channel transistor 652 and turning on N-channel transistor 652. When N-channel transistor 652 turns on, P-channel transistors 642 and 643 also turn on. The drain current of P-channel transistor 643 is the start-up current, I(SU), which is injected at the node of resistor 333 and the inverting input of amplifier 310. The current I(SU) increases the voltage across resistor 333 and biases the inverting input of amplifier 310 so that the output of amplifier 310 is driven low.

Thus, the combined effects of I(SU) and V(PC) are: (a) to ensure V(bg) is non-zero; and (b) to rapidly turn on P-channel transistors 301–304. The rapid turn on of P-channel transistor 303 means that V(bg) begins to rise very quickly after the Band-Gap Enable signal goes high. As V(bg) rises, N-channel transistor 651 turns on and shorts the gate of N-channel transistor 652 to ground, thereby shutting N-channel transistor 652 off. When N-channel transistor 652 turns off, P-channel transistors 642 and 643 also turn off, thereby shutting off the start-up current, I(SU).

Also, as the output current of inverter 615 charges the voltage on capacitor 620 to a high state, both inputs of XOR gate 605 become high and the Start signal at the output of ZOR gate 605 becomes low again. This turns off pre-charge bias generator 625, so that the V(PC) output goes back to a high impedance state.

Thus, the start-up current, I(SU) and the bias voltage, V(PC), are only active for a very brief period of time (i.e., less than 0.5 microseconds) after the Band-Gap Enable signal goes high. The duration of V(PC) is controlled by the charge time of capacitor 620, which is determined by the output current of inverter 615 and the value of capacitance of capacitor 620. The duration of I(SU) is determined by how fast the band-gap reference voltage, V(bg), rises and turns on N-channel transistor 651.

Although the present invention has been described with an exemplary embodiment, various changes and modifications may be suggested to one skilled in the art. It is intended that the present invention encompass such changes and modifications as fall within the scope of the appended claims.

What is claimed is:

1. A band-gap reference circuit comprising:

a first current source for generating a first reference current;

a first circuit branch for receiving a portion of said first reference current, said first circuit branch comprising a first resistor having a positive temperature coefficient connected in series with a base-emitter junction of a first PNP diode having a negative temperature coefficient, wherein an emitter current of said first PNP diode develops a first combined voltage across said series connection of said first resistor and said base-emitter junction of said first PNP diode;

a comparison circuit for comparing said first combined voltage to a base-emitter voltage of a second PNP diode and, in response to said comparison, adjusting a band-gap reference voltage; and a correction current generating circuit capable of injecting a correction current into an emitter of said second PNP diode, wherein said injected correction current at least partially offsets a non-linear drop-off in said band-gap reference voltage caused by said second PNP diode as temperature increases.

2. The band-gap reference circuit as set forth in claim 1 further comprising a second current source for generating a second reference current equal to said first reference current, wherein said emitter of said second PNP diode receives at least a portion of said second reference current.

3. The band-gap reference circuit as set forth in claim 2 wherein said correction current generating circuit comprises a first biased-off P-channel transistor, wherein a first leakage current of said first biased-off P-channel transistor comprises at least a portion of said correction current.

4. The band-gap reference circuit as set forth in claim 3 wherein said first leakage current increases non-linearly as temperature increases.

5. The band-gap reference circuit as set forth in claim 4 wherein said correction current generating circuit comprises a second biased-off P-channel transistor, wherein a second leakage current of said second biased-off P-channel transistor comprises at least a portion of said correction current.

6. The band-gap reference circuit as set forth in claim 5 wherein said second leakage current increases non-linearly as temperature increases.

7. The band-gap reference circuit as set forth in claim 6 further comprising a correction current control circuit for combining said first and second leakage currents to form said correction current.

8. The band-gap reference circuit as set forth in claim 1 wherein said correction current control circuit combines said first and second leakage currents according to a process corner of said band-gap reference circuit.

9. A cellular telephone comprising:

a voltage regulator capable of receiving a supply voltage from a battery of ,said cellular telephone and generating a regulated output voltage;

analog-to-digital circuitry capable of converting analog signal in said cellular telephone to digital signals; and a band-gap reference circuit capable of supplying a band-gap reference voltage to said voltage regulator and said analog-to-digital circuitry, wherein said band-gap reference voltage is relatively constant across an operating temperature range, said band-gap reference circuit comprising:

a first current source for generating a first reference current;

a first circuit branch for receiving a portion of said first referenced current, said first circuit branch comprising a first resistor having a positive temperature coefficient connected in series with a base-emitter junction of a first PNP diode having a negative temperature coefficient, wherein an emitter current of said first PNP diode develops a first combined voltage across said series connection of said first resistor and said base-emitter junction of said first PNP diode;

a comparison circuit for comparing said first combined voltage to a base-emitter voltage of a second PNP diode and, in response to said comparison, adjusting said band-gap reference voltage; and a correction current generating circuit capable of injecting a correction current into an emitter of said second PNP diode, wherein said injected correction current at least partially offsets a non-linear drop-off in said band-gap reference voltage caused by said second PNP diode as temperature increases.

10. The cellular telephone as set forth in claim 9 further comprising a second current source for generating a second reference current equal to said first reference current, wherein said emitter of said second PNP diode receives at least a portion of said second reference current.

11. The cellular telephone as set forth in claim 10 wherein said correction current generating circuit comprises a first biased-off P-channel transistor, wherein a first leakage current of said first biased-off P-channel transistor comprises at least a portion of said correction current.

12. The cellular telephone as set forth in claim 11 wherein said first leakage current increases non-linearly as temperature increases.

13. The cellular telephone as set forth in claim 12 wherein said correction current generating circuit comprises a second biased-off P-channel transistor, wherein a second leakage current of said second biased-off P-channel transistor comprises at least a portion of said correction current.

14. The cellular telephone as set forth in claim 13 wherein said second leakage current increases non-linearly as temperature increases.

15. The cellular telephone as set forth in claim 14 further comprising a correction current control circuit for combining said first and second leakage currents to form said correction current.

16. The cellular telephone as set forth in claim 9 wherein said correction current control circuit combines said first and second leakage currents according to a process corner of said band-gap reference circuit.

17. A method of operating a band-gap reference circuit comprising the steps of:

generating a first reference current;

receiving a portion of the first reference current in a first circuit branch comprising a first resistor having a positive temperature coefficient connected in series with a base-emitter junction of a first PNP diode having a negative temperature coefficient, such that an emitter current of the first PNP diode develops a first combined voltage across the series connection of the first resistor and the base-emitter junction of the first PNP diode;

comparing the first combined voltage to a base-emitter voltage of a second PNP diode;

in response to the comparison, adjusting a band-gap reference voltage; and injecting a correction current into an emitter of the second PNP diode, wherein the injected correction current at least partially offsets a non-linear drop-off in the band-gap reference voltage caused by the second PNP diode as temperature increases.

18. The method of operating a band-gap reference circuit as set forth in claim 17 further comprising the step of generating a second reference current equal to the first reference current, wherein the emitter of the second PNP diode receives at least a portion of the second reference current.

19. The method of operating a band-gap reference circuit as set forth in claim 18 further comprising the step of generating at least a portion of the correction current from a first leakage current of a first biased-off P-channel transistor.

20. The method of operating a band-gap reference circuit as set forth in claim 19 wherein the first leakage current increases non-linearly as temperature increases.

21. The method of operating a band-gap reference circuit as set forth in claim 20 further comprising the step of generating at least a portion of the correction current from a second leakage current of a second biased-off P-channel transistor.

22. The method of operating a band-gap reference circuit as set forth in claim 21 wherein the second leakage current increases non-linearly as temperature increases.

* * * * *